US006202723B1

(12) United States Patent
Maeng

(10) Patent No.: US 6,202,723 B1
(45) Date of Patent: Mar. 20, 2001

(54) PROTECTIVE COVER FOR GOLF CLUB WITH SLIT SHAFT PORTION

(76) Inventor: Seop Maeng, 22-102, Hanyang Apartment, Songpa-Dong, Songpa-Ku, Seoul (KR)

( * ) Notice: Subject to any disclaimer, the term of this patent is extended or adjusted under 35 U.S.C. 154(b) by 0 days.

(21) Appl. No.: 09/119,568

(22) Filed: Jul. 20, 1998

(30) Foreign Application Priority Data

Jul. 22, 1997 (KR) ..... 97-19275

(51) Int. Cl.[7] ..... A63B 57/00
(52) U.S. Cl. ..... 150/160; 206/315.2; 206/315.4
(58) Field of Search ..... 150/160, 159; 206/315.2, 315.4

(56) References Cited

U.S. PATENT DOCUMENTS

| | | | | |
|---|---|---|---|---|
| 2,035,529 | * | 3/1936 | Bucklin | 150/160 |
| 2,508,525 | * | 5/1950 | Le Fevre | 150/160 |
| 3,117,609 | * | 1/1964 | Pio | 150/160 |
| 3,613,760 | * | 10/1971 | Koehnle | 150/160 |
| 3,664,399 | * | 5/1972 | Neff | 150/160 |
| 3,667,078 | * | 6/1972 | Distasio | 206/315.4 X |
| 3,892,267 | * | 7/1975 | Bibeau | 150/160 |
| 4,195,677 | * | 4/1980 | Hagg et al. | 150/160 |
| 4,378,832 | * | 4/1983 | Thompson | 150/160 |
| 5,000,238 | * | 3/1991 | Zeller | 150/160 |
| 5,005,624 | * | 4/1991 | Sung | 206/315.4 X |
| 5,437,320 | * | 8/1995 | Sung | 206/315.4 X |
| 5,547,193 | * | 8/1996 | Sander | 150/160 X |

FOREIGN PATENT DOCUMENTS

| | | | | |
|---|---|---|---|---|
| 383013 | * | 11/1932 | (GB) | 150/160 |

* cited by examiner

*Primary Examiner*—Sue A. Weaver
(74) *Attorney, Agent, or Firm*—Chapman & Cutler

(57) ABSTRACT

A protective cover for a golf club which includes a cylindrical shaft cover having a cutout formed at the middle portion of the shaft cover, a slit extending longitudinally along the side wall of the shaft cover, and an unfolding groove or hinge extending longitudinally along the shaft cover opposite the slit. The shaft cover can be easily unfolded upon being bent at the cutout and can be easily recovered to its original state because it is made of a flexible resilient material.

19 Claims, 5 Drawing Sheets

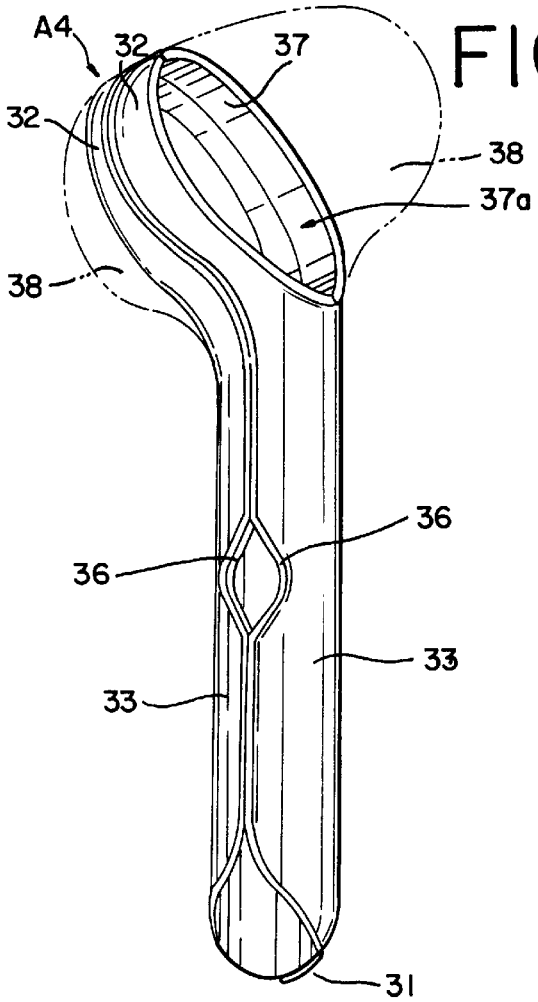
FIG.11
FIG.12
PRIOR ART
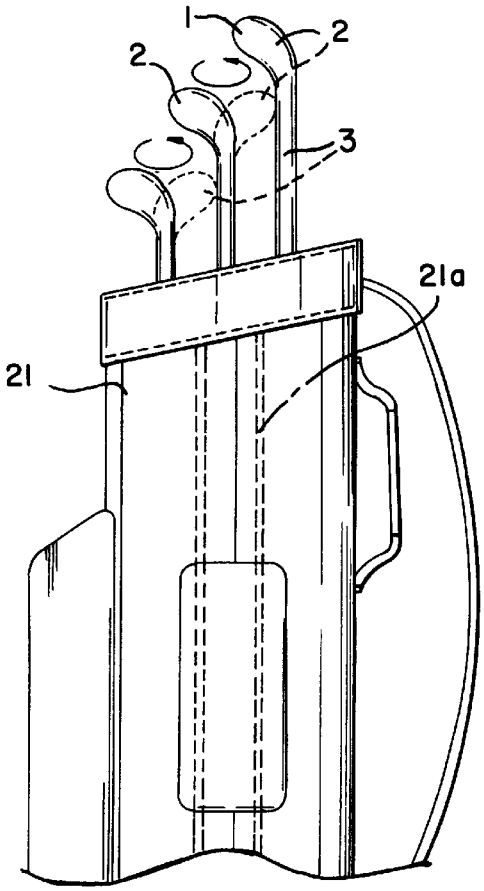
FIG.13
PRIOR ART
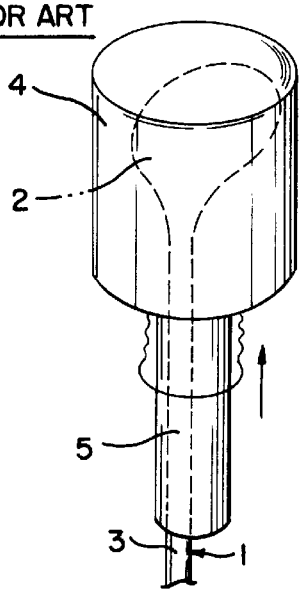
FIG.14
PRIOR ART
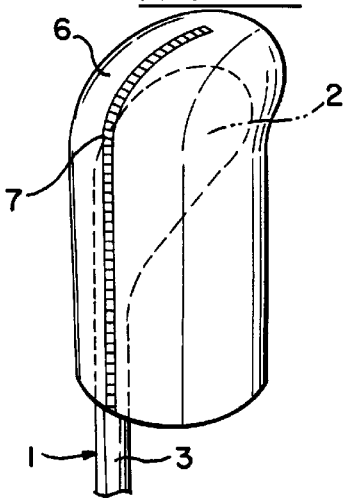

PROTECTIVE COVER FOR GOLF CLUB WITH SLIT SHAFT PORTION

BACKGROUND OF THE INVENTION

1. Field of the Invention

The present invention relates to a protective cover for a golf club particularly adapted to protect the upper portion of the golf club, namely, the head and shaft of the golf club adjacent the head.

2. Background Discussion

Referring to FIG. 12, a golf bag is illustrated, in which golf clubs 1 are received. The golf bag, which is denoted by the reference numeral 21 in FIG. 12, is partitioned to receive separately a plurality of golf clubs therein. The golf bag 21 also has a slope at the entrance thereof so that the user can easily and conveniently extract golf clubs 1 from the golf bag 21 upon using those golf clubs. Golf clubs 1 are received in the golf bag 21 while being arranged together in parallel in such a manner that those having a shorter length are received in the front portion of the golf bag 21 whereas those having a longer length are received in the rear portion of the golf bag 21. Accordingly, the golf clubs 1 can be easily selected upon their use in accordance with their range. Meanwhile, when the user carries the golf bag 21, golf clubs 1 received in the golf bag 21 may move, so that they come into contact with one another.

Where golf clubs 1 are received in the golf bag 21 in a manner shown in FIG. 12, the head 2 of short club adjacent a longer club comes into contact with the shaft 3 of the longer golf club, frequently causing the shaft 3 of the longer golf club to be scratched. As a result, the paint layer on the surface of the shaft 3 being scratched is peeled off. This results in a degradation in the appearance of the golf club. In order to solve such a problem, a head cover illustrated in FIG. 13 has been proposed. As shown in FIG. 13, such a head cover has a head cover portion 4 adapted to enclose the head 2 of a golf club 1, and a shaft cover portion 5 adapted to enclose the upper portion of the shaft 3 of the golf club 1. The head cover is put on the golf club 1 before the golf club 1 is received in the golf bag 21. That is, the head cover is put on the golf club 1 by inserting the head 2 of the golf club 1 into an opening defined at the lower end of the shaft cover portion 5 under the condition in which the golf club 1 is inserted in an inverted state, until the head 2 is enclosed by the head cover portion 4 while the shaft 3 is enclosed by the shaft cover portion 5.

Accordingly, it is possible to prevent the shaft 3 of the golf club 1 from being damaged due to its movement occurring while carrying the golf bag, because the head cover encloses the head 2 and shaft 3. However, the dimensions of the opening of the head cover portion 4 are small relative to the dimensions of the head 2. Due to such a small dimensions of the opening, considerable effort is required to put the head cover on and take it off the head 2 of the golf club 1. In other words, it is very difficult to put the head cover on the golf club 1 rapidly, because the user must insert the head 2 of the golf club 1 into the opening of the head cover while widening the opening by hand. Upon taking off the head cover, a strong force is required to extract the head of the golf club through the narrow opening of the head cover.

Furthermore, when the golf club 1 with the head cover thereon is placed into the golf bag 21, its shaft cover portion 5 may come into contact, at the lower end thereof, with the head covers on other golf clubs already received in the golf bag 21, or with the upper ends of the partitions 21*a* shown in dotted lines provided in the golf bag 21. As a result, the head cover portion 5 of the head cover may shift upwardly due to contact of its lower end with such head covers on other golf clubs already received in the golf bag 21, or with the upper ends of the partitions 21*a*. When the head cover portion 5 of the head cover shifts upwardly at its lower end as mentioned above, the shaft 3 of the golf club 1 is exposed, so that it may come into direct contact with other golf clubs directly or with head covers on such golf clubs. For this reason, this still results in a degradation in the appearance of the golf club shaft due to wear.

FIG. 14 illustrates another conventional head cover. This head cover has a cover body 6 adapted to enclose both the head 2 and the lower portion of the shaft 3 of a golf club. The cover body 6 is longitudinally slitted along the cover body 6 to allow an easy insertion of the head 2 and shaft 3 of the golf club 1 into the head cover. The head cover also has a slide fastener attached to the slitted portion of the cover body 6. In the case of this head cover, the slide fastener 7 attached to the cover body 6 is open upon putting the head cover on the golf club 1. Thereafter, the head 2 of the golf club 1 is inserted into the head cover through the widen opening of the head cover. After the insertion, the slide fastener 7 is closed. Thus, the head cover is put on the golf club 1, so that it protects the head 2 and the lower portion of the shaft 3. However, this head cover still is inconvenient to use because the slide fastener 7 must be manipulated, opening and closing it every time the head cover is put on, or taken off, the golf club. Typically, the head cover is made of a thick fabric in order to provide a buffering function. For this reason, the head cover is bulky, so that it unnecessarily occupies a great deal of space. This leads to a bulky structure of the golf bag 21 itself. In contrast, U.S. Pat. No. 5,547,193 discloses a golf club head cover similar to that depicted in FIG. 13 with a portion adapted to enclose the head of a golf club, and a shaft cover portion extending downwardly from the head cover portion and serving to enclose the lower portion of the shaft of the golf club. This golf club cover has a different configuration from the head cover of FIG. 13, only in that it has a longitudinal slot formed in the shaft cover portion in order to insert conveniently the head and shaft of the golf club into the cover. However, this golf club cover still is inconvenient to use because the insertion of the head and shaft of the golf club into the cover is carried out under the condition in which the slot is widen.

SUMMARY OF THE INVENTION

It is an objective of this invention to solve the above mentioned problems involved in the prior art and to provide a protective cover for a golf club having a configuration including a shaft cover which can be easily bent and recovered from the bent state, thereby being capable of being easily put on the golf club and taken off from the golf club, so that the shaft cover not only can prevent the head and shaft of the golf club from being damaged when the golf club comes into contact with other golf clubs, but also can be conveniently used.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, ease of manufacture, convenience of use, and protection for golf clubs.

The first feature of the protective cover for a golf club of this invention is a head cover member adapted to enclose a head of the golf club.

The second feature is a shaft cover member connected to the head cover member and adapted to enclose a portion of a shaft of the club adjacent the head of the golf club. The shaft cover member has a side wall with a slit extending longitudinally along its entire length. Along the side wall is a cutout formed in the shaft cover along the slit, and the user bends the shaft cover about this cutout to open the shaft cover to receive the shaft. Preferably, the shaft cover member is covered with a protective sheath made of a cotton fabric.

The third feature is an unfolding groove formed on an inner surface portion of the side wall opposite to the slit. This unfolding groove extends longitudinally along the entire length of the side wall, and may have, for example, a V-shape or a U-shape. The side wall has a thickness greater than the portion thereof in which the unfolding groove is formed. The slit is widen when the shaft cover is longitudinally bent at the cutout, thereby causing the shaft cover to be unfolded. The head cover member may be attached to a connector section of the shaft cover member which extends from a portion of an upper end of the shaft cover member where the unfolding groove is formed.

In one embodiment, the protective cover for a golf club of this invention includes a cylindrical shaft cover having a cutout formed at the middle portion of the shaft cover, a slit extending longitudinally along the shaft cover, and an unfolding groove extending longitudinally along the shaft cover facing the slit, so that the shaft cover can be easily unfolded upon being bent at the cutout and can easily recover to its original state, thereby achieving an easy and convenient use and an easy and simple manufacture.

In another embodiment, the protective cover comprises a pair of cover members, each cover member having a head cover portion and a shaft cover portion including an extended portion longitudinally extending along the length to the cover member. The longitudinal extended portions of the cover members are connected by a hinge member to enable these cover members to open and close. Each longitudinal extended portion has an edge with a locking member such as, for example, magnets. The locking members face each other upon the members being moved into the closed position and engaging upon closing the cover members Preferably, there is a slant plane for opening and closing formed at an end of the extending portion, and a groove formed at a mid-portion of the extending portion.

In still another embodiment, the protective cover comprises substantially identical left hand and right hand cover members hingedly connected together along a longitudinally extended portion extending substantially along the length to the cover members to enable said cover members to be opened and closed manually. Each cover member has a substantially hemispherical head cover portion and a substantially semi-cylindrical shaft cover portion, whereupon with the closure of the left hand and right hand cover members, the head cover portions substantially enclose the head of a golf club inserted into the protective cover and the shaft cover portions substantially enclose the shaft of a golf club adjacent the head of the golf club inserted into the protective cover.

BRIEF DESCRIPTION OF THE DRAWING

The preferred embodiments of this invention, illustrating all its features, will now be discussed in detail. These embodiments depict the novel and non-obvious protective cover for a golf club of this invention as shown in the accompanying drawing, which is for illustrative purposes only. This drawing includes the following figures (FIGS.), with like numerals indicating like parts:

FIG. 6(*b*) is a enlarged sectional view of a portion of the shaft cover similar to that shown in FIG. 6*a*, illustrating another embodiment of an unfolding groove;

FIG. 10(*b*) is a perspective view illustrating an almost completely folded state of the protective cover shown in FIG. 10(*a*);

FIG. 11 is a perspective view illustrating a forth embodiment of the protective cover for a golf club according to the present invention;

FIG. 12 is a side view illustrating a state in which golf clubs are received in a golf bag in a conventional manner;

FIG. 13 is a perspective view illustrating one conventional protective cover for a golf club; and FIG. 14 is a perspective view illustrating another conventional protective cover for a golf club.

DETAILED DESCRIPTION OF THE PREFERRED EMBODIMENTS

Figure 1:
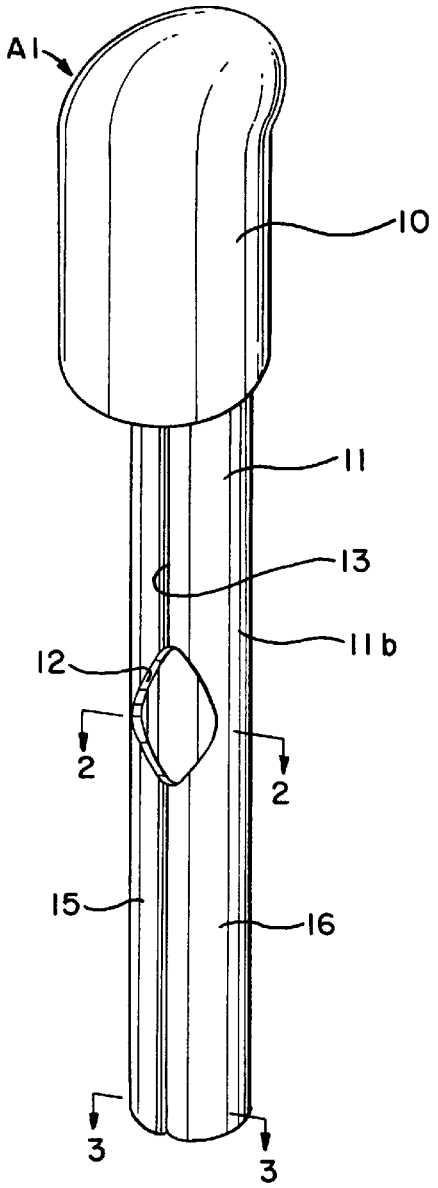
FIG. 1 is a perspective view illustrating the first embodiment of the protective cover for a golf club.
Figure 2:
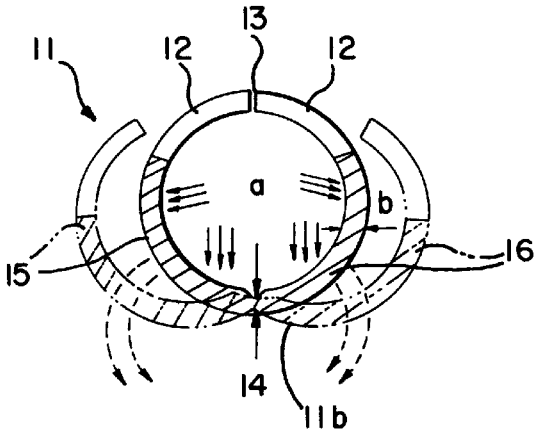
FIG. 2 is a cross-sectional view taken along the line 2—2 of FIG. 1.
Figure 3:
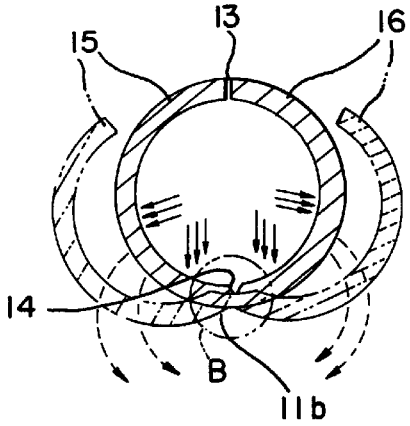
FIG. 3 is a cross-sectional view taken along the line 3—3 of FIG. 1.
Figure 4:
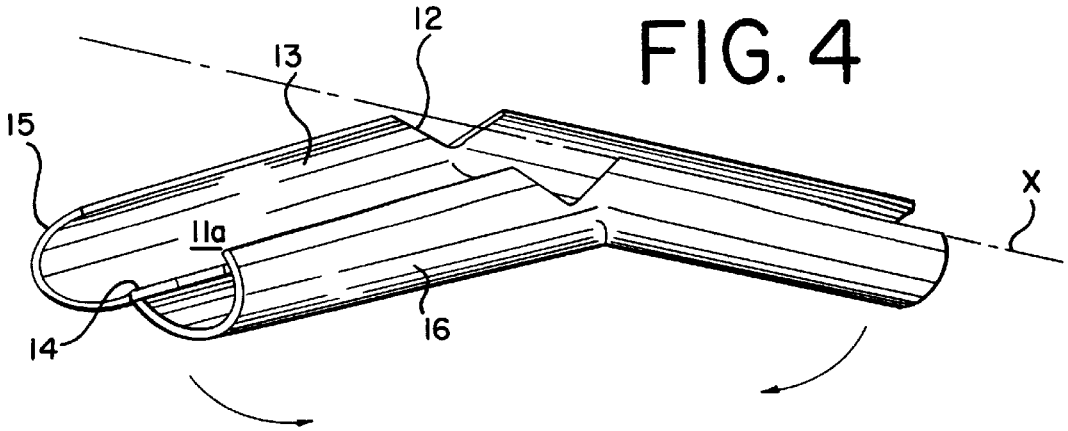
FIG. 4 is a front perspective view illustrating a shaft cover included in the protective cover of FIG. 1, with the shaft cover being in an unfolded state.
Figure 5:
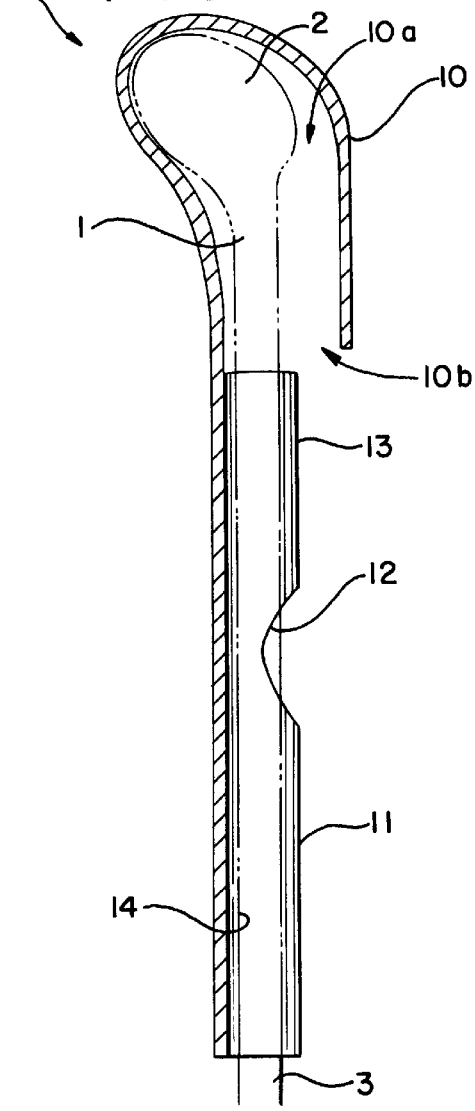
FIG. 5 is a side view, partially in cross-section, illustrating the protective cover shown in FIG. 1 covering a golf club head, including the shaft of the golf club adjacent the head.

Referring to FIG. 1, a protective cover for a golf club having a configuration according to the first embodiment of the present invention is illustrated. As shown in FIG. 1, the protective cover, which is denoted by the reference character A1, includes a head cover 10 and a shaft cover 11 connected to the head cover and extending downwardly therefrom. The head cover 10 is an enlarged bulb-like member with a hollow interior 10*a* with an enlarged open mouth 10*b* with a diameter larger than the diameter of the head 2 of the golf club 1. Connected to the head cover 10 is a pair of semi-cylindrical portions 15 and 16, which, upon closure of the protective cover A1, provide a hollow cylindrical internal structure having a substantially O-shaped cross-section. Each portion 15 and 16 of the shaft cover 11 is made of a substantially rigid, yet flexible, resilient material and each has a V-shaped cutout 12 approximately at its middle section. As illustrated in FIG. 4, the shaft cover 11 can be longitudinally bent along the V-shaped cutouts 12 substantially at a right angle to the longitudinal axis X of the protective cover A1 to open the shaft cover 11, exposing inner surfaces 11*a* thereof.

Figure 6A:
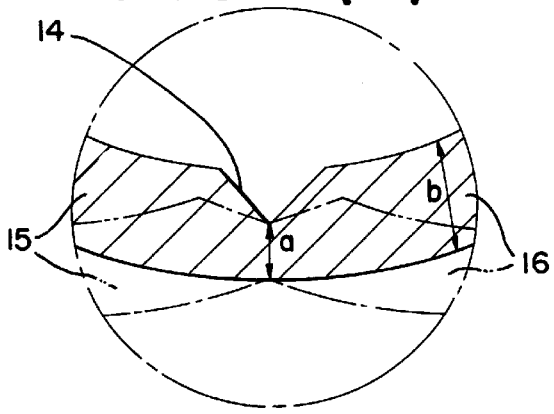
FIG. 6(*a*) is an enlarged sectional view of a portion of the shaft cover encircled by the line B in FIG. 3.
Figure 6B:
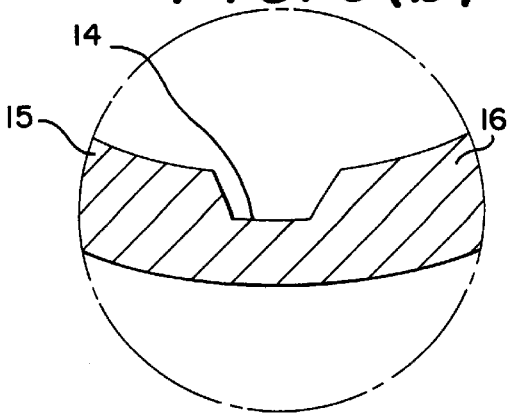

A slit 13 extends longitudinally along the entire length of the side wall 11*b* shaft cover 11, intersecting each of the cutouts 12. An unfolding groove 14 is formed on the inner surface portion 11*a* (FIG. 4) of the shaft cover 11 opposite to the slit 13 to form a hinge element joining together the pair of semi-cylindrical portions 15 and 16. The unfolding groove 14 extends longitudinally along the entire length of the shaft cover 11 substantially parallel to the longitudinal axis X of the protective cover A1. As best shown in FIG. 6(*a*), each of the semi-cylindrical portions 15 and 16 have a thickness b (typically less than ½–¼ inch) and the unfolding groove 14 has a thickness a which is less than the thickness b. Moreover, although the unfolding groove 14 has a V-shape as shown in FIG. 6(*a*), it may have a U-shape as shown in FIG. 6(*b*). The preferred form of the protective cover A1 has been described as including both the head cover 10 and shaft cover 11 coupled to each other. An alternate version, however, may be provided which only includes the shaft cover 11.

Now, the operation of the protective cover A1 will be described.

Where it is desired to put the protective cover A1 on a golf club 1, the head cover 10 is first put on the head 2 of the golf club 1, and then the shaft cover 11 is longitudinally bent about the cutout 12 as depicted in FIG. 4 in such a manner that the cutout 12 is widen, that is the V-shape expands with the legs of the V moving away from each other. At this time, the semi-cylindrical shaft cover portions 15 and 16 are subjected to a lateral unfolding pressure while simultaneously being subjected to a downward pressure. The lateral unfolding pressure and downward pressure applied to the semi-cylindrical portions 15 and 16 is converted into a pivoting force serving to downwardly pivot the semi-cylindrical portions to pivot about the unfolding groove 14. As the semi-cylindrical portions 15 and 16 pivot to be unfolded, the V-shaped cutout 12 is completely widen. Accordingly, the shaft cover 11 is sufficiently unfolded to receive the shaft 3 of the golf club In this state, the shaft 3 of the golf club 1 is then inserted into the shaft cover 11. After the insertion of the golf club shaft 3, the bent state of the shaft cover 11 is released, thereby, due to the resilient nature of the material of the shaft cover portions 15 and 16, these shaft cover portions pivot upwardly to return their original position as shown in FIG. 1. Thus, the protective cover A1 is in a state enclosing the golf club 1. The unfolding angle of the shaft cover 11 can be optionally adjusted by adjusting the cutout angle of the cutout 12. That is, the unfolding angle of the shaft cover 11 increases at a larger cutout angle of the cutout 12 and decreases at a smaller cutout angle. Preferably, the shaft cover is made of a synthetic resin exhibiting superior elasticity.

Figure 7:
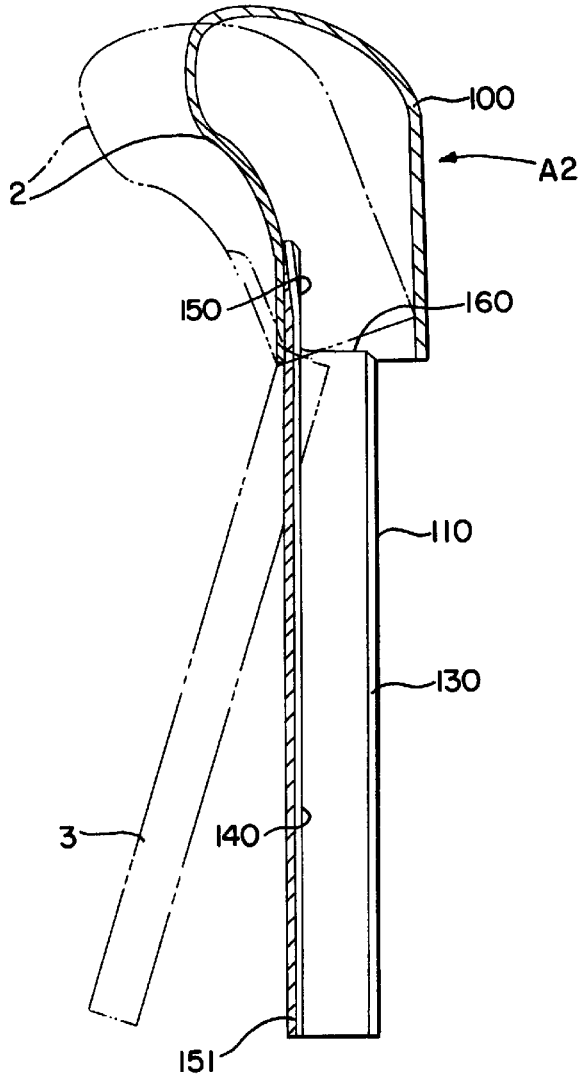
FIG. 7 is a sectional view illustrating a second embodiment of a protective cover for a golf club according to the present invention.

FIG. 7 is a sectional view illustrating a protective cover A2 according to another embodiment of the present invention. In accordance with this embodiment, the protective cover A2 has no cutout such as the cutout 12. As shown in FIG. 7, this protective cover A2 has a shaft cover 110 made of a flexible, resilient material which has a slit 130 extending longitudinally along the entire length of the shaft cover 110, and an unfolding groove 140 formed on the inner surface portion of the shaft cover 110 opposite to the slit 130 while extending longitudinally along the entire length of the shaft cover 110. An extension 150 extends from at a portion of the upper end of the shaft cover 110 where the unfolding groove 140 is formed. A protective sheath 151 made of a cotton fabric may be used to cover the exterior of the shaft cover 110.

The extension 150 is formed by cutting away the upper end of the shaft cover 110 except for the portion where the unfolding groove 140 is formed. Accordingly, a bending step 160 is defined at the lower end of the extension 150. A head cover 100 is attached to the extension 150. In the case of this protective cover A2, when the shaft cover 110 is bent at its portion adjacent to the bending step 160, the slit 130 of the shaft cover 110 is widen or opened, thereby allowing an insertion of the golf club into the shaft cover 10, placing the head 2. When the bent state of the shaft cover 110 is released, the shaft cover returns to its original state. Accordingly, the shaft 3 of the golf club 1 is safely enclosed in the shaft cover 110.

As apparent from the above description, the present invention provides a protective cover for a golf club having a configuration including a shaft cover, which can be easily bent and recovered from the bent state, thereby being capable of being easily put on the golf club. Accordingly, the protective cover of the present invention is very convenient in use. In particular, since the protective cover has a very simple structure, it provides a great reduction in labor costs.

Figure 8:
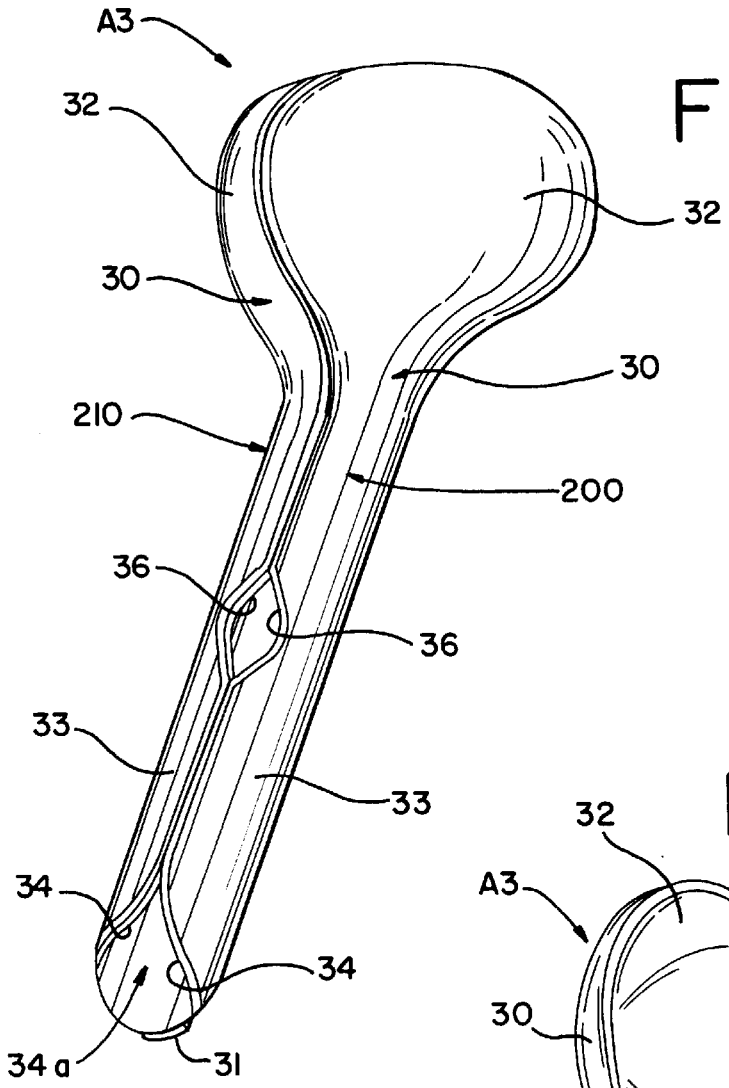
FIG. 8 is a perspective view illustrating a third embodiment of a protective cover of a golf club according to the present invention.
Figure 9:
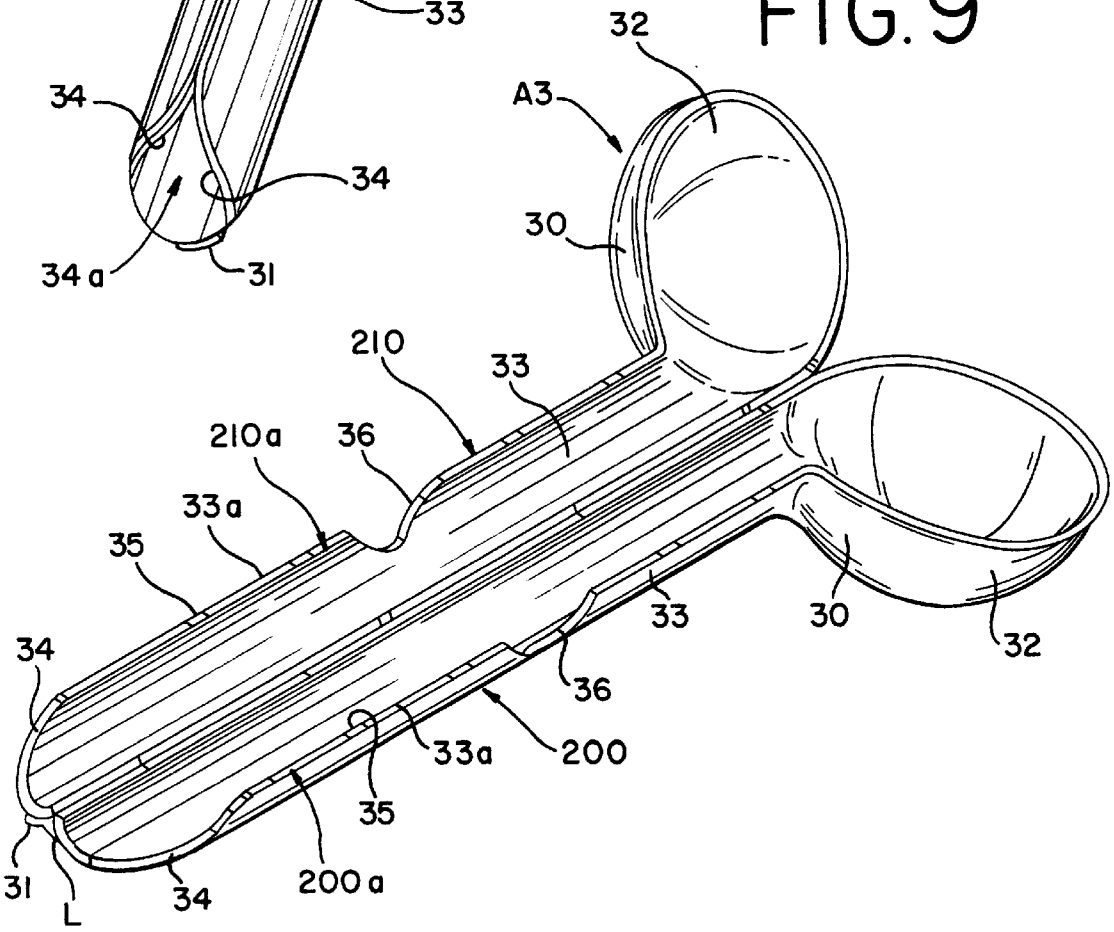
FIG. 9 is a perspective view illustrating an unfolded state of the protective cover shown in FIG. 8.

Referring to FIGS. 8 and 9, the protective cover A3, the third embodiment of this invention, comprises a pair of substantially identically shaped, right and left hand cover members 200 and 210, each including an extending portions 33, joined together along a longitudinal edge L by a hinge member formed by a flexible connecting plate 31 which is sewn or bonded by an adhesive. In this embodiment, although the right and left hand members 200 and 210 are connected by the connecting plate 31, the hinge may be formed by other means such as illustrated in FIGS. 6(*a*) and 6(*b*). In any event, a longitudinal hinge is created between the right and left hand cover members 200 and 210 along the extending portions 33.

These right and left hand cover members 200 and 210 are preferably injected molded from a thermoplastic material, and each right and left hand cover member 200 and 210, respectively, includes a substantially hemispherical head cover portion 32 and a substantially semi-cylindrical shaft cover portion 30 extending from an adjoining head cover portion and integrally formed therewith during the molding process. The flexible connecting plate 31 enables the right and left hand members 200 and 210 to be manually moved between an open position shown in FIG. 9 and a closed position shown in FIG. 8. The respective edges 33*a* (FIG. 9) of extending portions 33 have permanent magnets 35 embedded therein, with magnets of opposite polarity facing with each other and which abut each other when the cover members 200 and 210 are in the closed position shown in FIG. 8. The magnets 35 serve as fixing or locking means which hold the right and left hand cover members 200 and 210 in the closed position until manually separated.

When the right and left hand cover members 200 and 210 are in the closed position, the head cover portions 32 form a head recess for receiving a head 2 of a golf club 1 in an upper end of the protective cover A3, and the shaft cover portions 30 form a shaft recess for receiving the shaft 3 of a golf club. A slant edge or plane 34 is formed at an end of the extending portions 33 of right and left hand cover members 200 and 210, so that the protective cover A3 is easily opened and closed using the shaft of the golf club as the means for opening the protective cover. Alternately, a groove 36 for inserting a finger of an user is formed at the mid-portion of the extending portion 33.

Figure 10A:
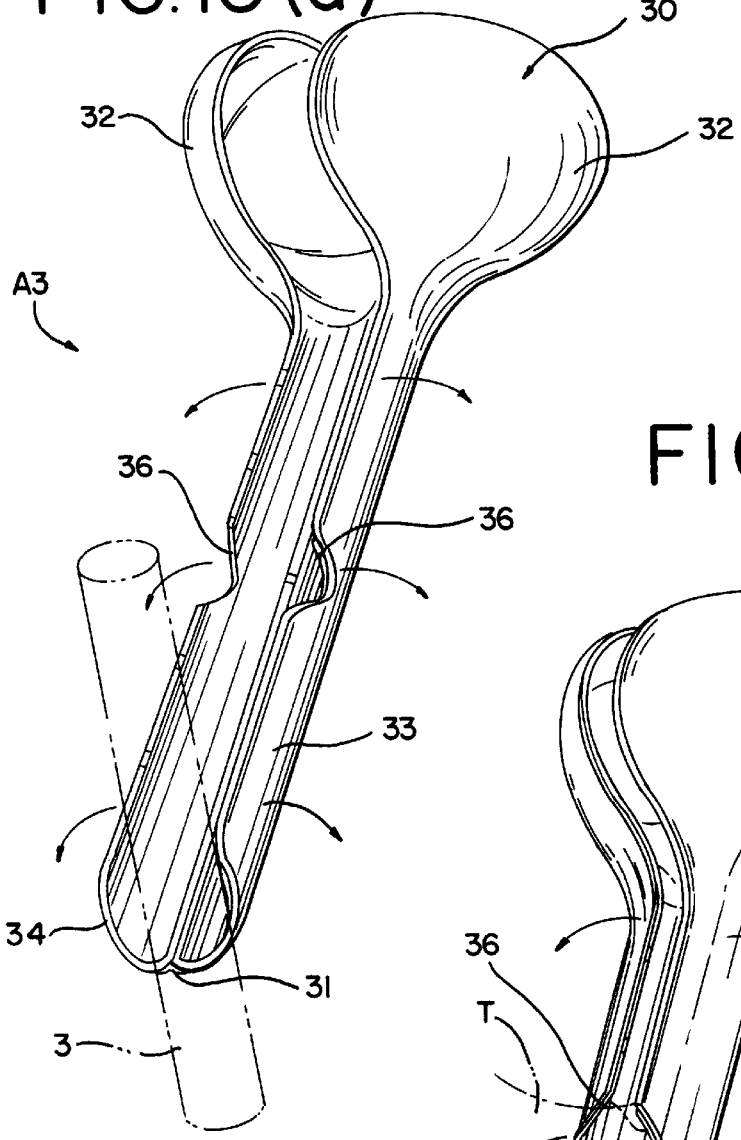
FIG. 10(*a*) is a perspective view illustrating a partially unfolded state of the protective cover shown in FIG. 8, with the shaft of a golf club being inserted into this protective cover.
Figure 10B:
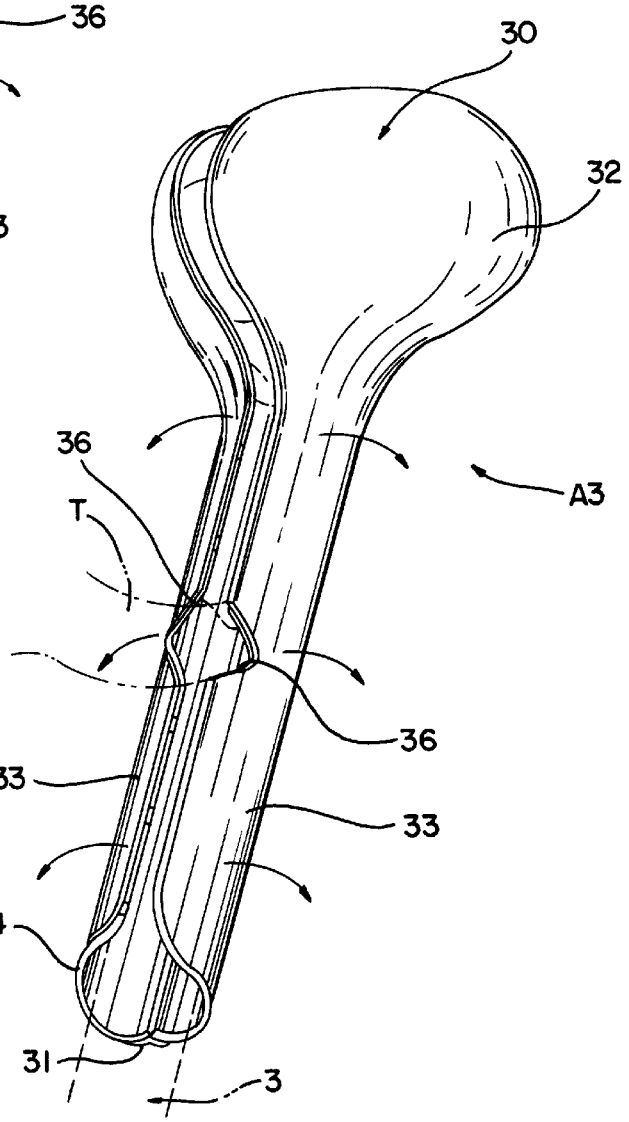

As shown in FIG. 10*a*, the protective cover A3 is opened by manually pushing the shaft 3 of the golf club 1 into the groove 34*a* (F(G. 8) formed between the slant planes 34 of the extending portion 33. As the shaft 3 is pushed toward the protective cover A3 into the groove 34*a*, the protective cover A3 is opened and the golf club is inserted into the opened protective cover A3. After insertion of the golf club 1 is completed, the right and left hand members 200 and 210 are manually closed by pushing them together, with the magnets 35 holding these members together in the closed position. As shown in FIG. 10*b*, instead of using the golf club to separate the right and left hand members 200 and 210, the user inserts his or her finger into a groove 36 formed in these members and pushes the members apart to open the protective cover A3.

Referring to FIG. 11, a forth embodiment of the present invention, the protective cover A4, is depicted. In this embodiment, a penetration hole 37 is formed by cutting away symmetrically the protruding section of the head cover 32 shown in FIG. 8. This provides an enlarged opening 37*a* which allows the enlarged head 2 of the golf club 1 to protruded through the opening 37*a*. Consequently, golf clubs having various sized heads 2 can be received by the protective cover A4, each different sized head penetrating the penetration hole 37*a* which has sufficiently large diameter to accommodate many different sized heads 2. A covering 38 for the portion of the golf club head 2 protruding through the opening 37*a* is shown in FIG. 11 as a double dotted line. This covering 38 provides a recess pocket which is preferably made of fabrics is connected to the frame 37 defining the opening 37*a*. This covering 38 may be sewn or other connected to the frame 37 and may be made of a fabric that stretches to adjust its size for heads 2 of varying sizes.

Scope of the Invention

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A protective cover for a golf club, the cover comprising;

a head cover member adapted to enclose a head of the golf club, a shaft cover member adapted to enclose a portion of a shaft of the club adjacent the head of the golf club, said shaft cover member being made of a resilient, flexible material and having a side wall with a slit extending longitudinally along the entire length of the side wall;

an unfolding groove formed on an inner surface portion of the side wall opposite to the slit, said unfolding groove extending longitudinally along the entire length of the side wall; and surfaces formed in the shaft cover along the slit defining a cutout on both sides of the slit, whereby when the shaft cover is longitudinally bent over, at the unfolding groove portion of the shaft cover opposite the cutout, the shaft cover unfolds along the slit from the cutout.

2. The protective cover defined in claim 1, wherein the surfaces formed in the shaft cover along the slit define a V-shaped cutout on either side of the slit.

3. The protective cover in accordance with claim 1 wherein the side wall has a thickness greater than the portion thereof in which the unfolding groove is formed.

4. The protective cover in accordance with claim 1 wherein the head cover member is attached to a connector section of the shaft cover member which extends from a portion of an upper end of the shaft cover member where the unfolding groove is formed.

5. The protective cover in accordance with claim 1 wherein the shaft cover member is covered with a protective sheath made of a cotton fabric.

6. The protective cover in accordance with claim 1 wherein the unfolding groove has a V-shape.

7. The protective cover in accordance with claim 1 wherein the unfolding groove has a U-shape.

8. A protective cover for a golf club, the cover comprising:

a pair of cover members, each of said cover members having a head cover portion and a shaft cover portion including a cooperating pair of extended portions longitudinally extending along the length of the cover member, the longitudinal extended portions of the cover members being connected together by a hinge member to enable said cover members to open and close, each longitudinal extended portion having an edge with a locking member, said locking members facing each other upon the members being moved into the closed position and engaging upon closing the cover members and an opening formed in each of the shaft cover members opposite the hinge member for facilitating manual opening of the cover members when the locking member is disengaged.

9. The protective cover in accordance with claim 8 including a slant plane for opening and closing formed at an end of the extended portion.

10. The protective cover in accordance with claim 8 where a groove is formed at a mid-portion of the extended portion.

11. The protective cover in accordance with claim 8 where the locking members are magnets.

12. A protective cover for a golf club including a shaft cover member made of a flexible resilient material and adapted to enclose a portion of a shaft of the club adjacent a head of the golf club, said shaft cover member having a side wall with a slit therein extending longitudinally along the entire length of the side wall, an unfolding groove formed in the side wall opposite to the slit, said unfolding groove extending longitudinally along the entire length of the side wall, and a cutout formed in the shaft cover along the slit which causes the shaft cover member (a) to open along the slit upon applying a bending force to the shaft cover member to bend the shaft cover member opposite the cutout, and (b) to close the shaft cover member upon releasing the bending force.

13. The protective cover of claim 12 where the shaft cover member is formed by a pair of substantially semi-cylindrical members joined longitudinally along the unfolding groove.

14. The protective cover of claim 13 where the semi-cylindrical members have free edges defining the slit, with the cutout comprising a substantially V-shaped cut-away section in each semi-cylindrical member opposite each other along the free edges.

15. A protective cover for a golf club, the cover comprising:

left hand and right hand cover members hingedly connected together along a longitudinally extended portion extending substantially along the length of the cover members to enable said cover members to be opened and closed manually about said hinge, each of the cover members having a substantially hemispherical head cover portion and a substantially semi-cylindrical shaft cover portion, whereupon with the closure of said left hand and right hand cover members, the head cover portions substantially enclose the head of a golf club inserted into the protective cover and said shaft cover portions substantially enclose the shaft of the golf club adjacent the head of the golf club inserted into the protective cover and an opening formed in each of the cover members opposite the hinge connection for facilitating manual opening of the cover members.

16. The protective cover of claim 15 where each longitudinal extended portion has an edge with a locking member, said locking members facing each other upon the left hand and right hand cover members being moved into the closed position and engaging upon closing the cover members.

17. The protective cover in accordance with claim 16 where the locking members are magnets.

18. The protective cover in accordance with claim 15 including a slant plane for opening and closing formed at an end of the extended portion.

19. The protective cover in accordance with claim 15 where a groove is formed at a mid-portion of the extended portion.

* * * * *